US008801467B2

(12) United States Patent
Lan

(10) Patent No.: US 8,801,467 B2
(45) Date of Patent: Aug. 12, 2014

(54) ELECTRICAL CONNECTOR

(71) Applicant: Cheng Uei Precision Industry Co., Ltd., New Taipei (TW)

(72) Inventor: Rong-Qin Lan, New Taipei (TW)

(73) Assignee: Chung Uei Precision Industry Co., Ltd., New Taipei (TW)

( * ) Notice: Subject to any disclaimer, the term of this patent is extended or adjusted under 35 U.S.C. 154(b) by 14 days.

(21) Appl. No.: 13/679,386

(22) Filed: Nov. 16, 2012

(65) Prior Publication Data

US 2014/0141651 A1 May 22, 2014

(51) Int. Cl.
*H01R 13/648* (2006.01)
*H01R 12/71* (2011.01)

(52) U.S. Cl.
CPC ..... *H01R 12/712* (2013.01)
USPC ..... 439/607.36; 439/79; 439/626

(58) Field of Classification Search
USPC ..... 439/626, 607.36, 83, 79
See application file for complete search history.

(56) References Cited

U.S. PATENT DOCUMENTS 5,725,386 A * 3/1998 Davis et al. ..... 439/79
6,135,790 A * 10/2000 Huang et al. ..... 439/79
6,210,224 B1 * 4/2001 Wu ..... 439/607.4
6,210,235 B1 * 4/2001 Wu ..... 439/676
6,224,422 B1 * 5/2001 Zhu et al. ..... 439/607.01
6,309,227 B1 * 10/2001 Chen et al. ..... 439/79
6,319,061 B1 * 11/2001 Chen et al. ..... 439/607.15
6,371,811 B1 * 4/2002 Chen et al. ..... 439/607.37
6,383,024 B1 * 5/2002 Wang et al. ..... 439/607.23
6,398,587 B1 * 6/2002 Chen et al. ..... 439/607.35
6,419,529 B1 * 7/2002 Shi et al. ..... 439/701
6,638,111 B1 * 10/2003 McDaid et al. ..... 439/607.09
7,717,745 B2 * 5/2010 He et al. ..... 439/607.23

* cited by examiner

*Primary Examiner* — Briggitte R Hammond
(74) *Attorney, Agent, or Firm* — Muncy, Geissler, Olds & Lowe, P.C.

(57) ABSTRACT

An electrical connector includes an insulating housing having an erect base body and an erect tongue board, a plurality of conductive terminals of which each has a fastening arm vertically disposed in the base body, a contact arm elastically projecting sideward out of a side face of the tongue board, and a touching arm projecting rearward out from a bottom of the base body, a front shell mounted rearward to the insulating housing with the tongue board and the contact arms being apart located therein, and a rear shell covered to the base body and over the touching arms. The touching arms are horizontally arranged at regular intervals along a transverse direction. The electrical connector is mounted onto the circuit board with the touching arms being elastically against and pressed upward by the circuit board to form electrical connection with the circuit board.

9 Claims, 4 Drawing Sheets

ELECTRICAL CONNECTOR

BACKGROUND OF THE INVENTION

1. Field of the Invention

The present invention generally relates to an electrical connector, and more particularly to an electrical connector capable of being mounted to and removed from a circuit board conveniently.

2. The Related Art

It is well known that electrical connectors are widely used in electronic products to electrically connect with a circuit board. Traditionally, the electrical connector is connected with the circuit board by soldering terminals thereof to the circuit board by means of a SMT method. As a result, it is rather time-consuming and inconvenient for mounting the electrical connector to the circuit board. And, when the terminals are not coplanar due to the inaccurate manufacturing, some terminals near the circuit board are easily soldered to the circuit board while other terminals apart from the circuit board are difficultly soldered to the circuit board. It results in a bad electrical connection between the terminals and the circuit board. Moreover, when the electrical connector needs to be replaced because it doesn't work, it will be an arduous task to remove the terminals from the circuit board, and the circuit board is easily damaged by inappropriate operations. So, an electrical connector capable of being mounted to and removed from a circuit board conveniently is required.

SUMMARY OF THE INVENTION

An object of the present invention is to provide an electrical connector which is adapted for being vertically mounted on a circuit board placed horizontally. The electrical connector includes an insulating housing, a plurality of conductive terminals, a front shell looped from a metal plate to show a rectangular tubular shape, and a rear shell curved from a metal plate.

The insulating housing has an erect base body and an erect tongue board extending forward from a front of the base body. Each of the conductive terminals has a fastening arm vertically disposed in the base body of the insulating housing. A top distal end of the fastening arm extends forward and is inclined sideward to form a contact arm of which a free end is slantwise bent back. A bottom distal end of the fastening arm extends rearward and is inclined downward to form a touching arm of which a free end is slantwise bent back. The contact arms elastically project sideward out of a side face of the tongue board and are arranged at regular intervals along a vertical direction. The touching arms project rearward out from a bottom of the base body and are horizontally arranged at regular intervals along a transverse direction. The front shell is mounted rearward to the insulating housing with the tongue board together with the contact arms of the conductive terminals being apart located therein. The rear shell is covered to the base body of the insulating housing and over the touching arms of the conductive terminals. The electrical connector is mounted onto the circuit board with the touching arms of the conductive terminals being elastically against and further pressed upward by the circuit board to form electrical connection with the circuit board.

As described above, the electrical connector and the circuit board are electrically connected with each other by way of the touching arms of the conductive terminals elastically abutting against the circuit board so that ensures a steady electrical connection between the electrical connector and the circuit board even if the touching arms are not coplanar due to the inaccurate manufacturing. It is rather short-time and convenient for mounting the electrical connector to the circuit board. Moreover, the touching arms of the conductive terminals are easily removed from the circuit board for the convenience of replacing the electrical connector when it doesn't work.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
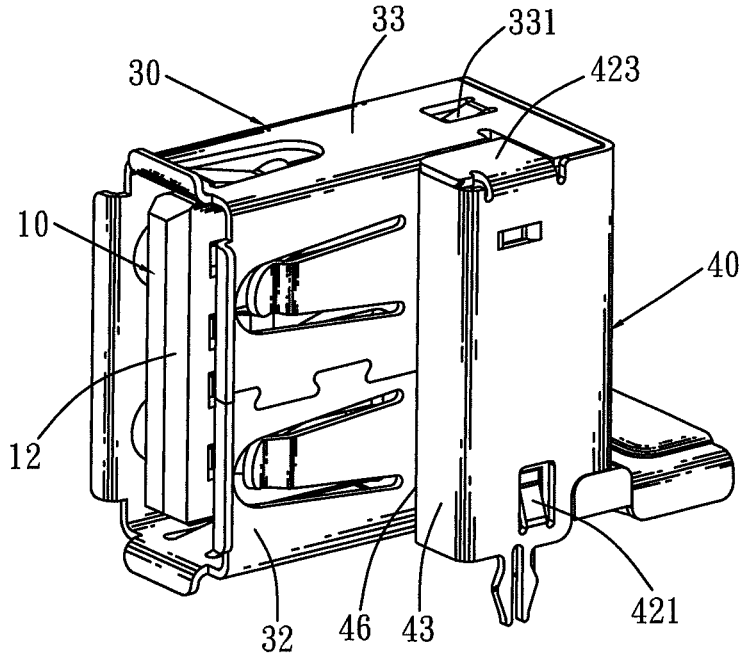
FIG. 1 is an assembled perspective view of an electrical connector according to an embodiment of the present invention.
Figure 2:
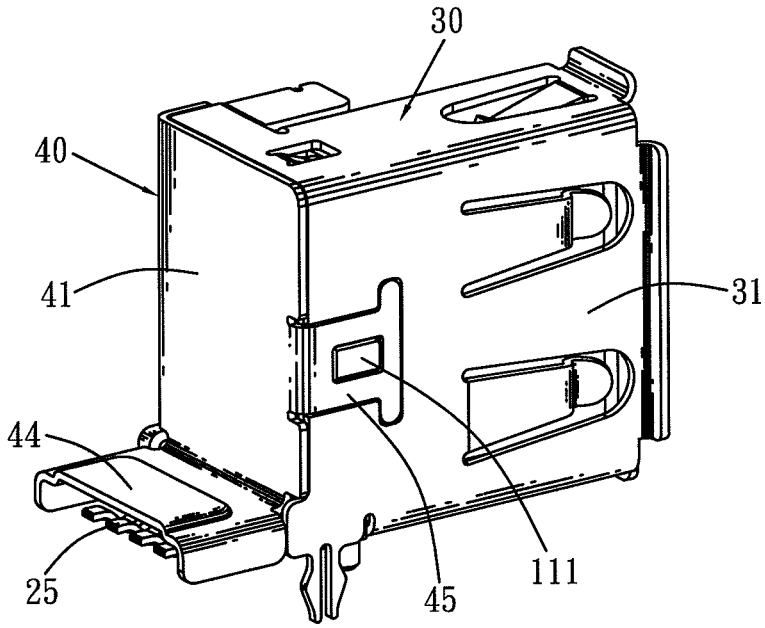
FIG. 2 is another angle of assembled perspective view of the electrical connector of FIG. 1.
Figure 3:
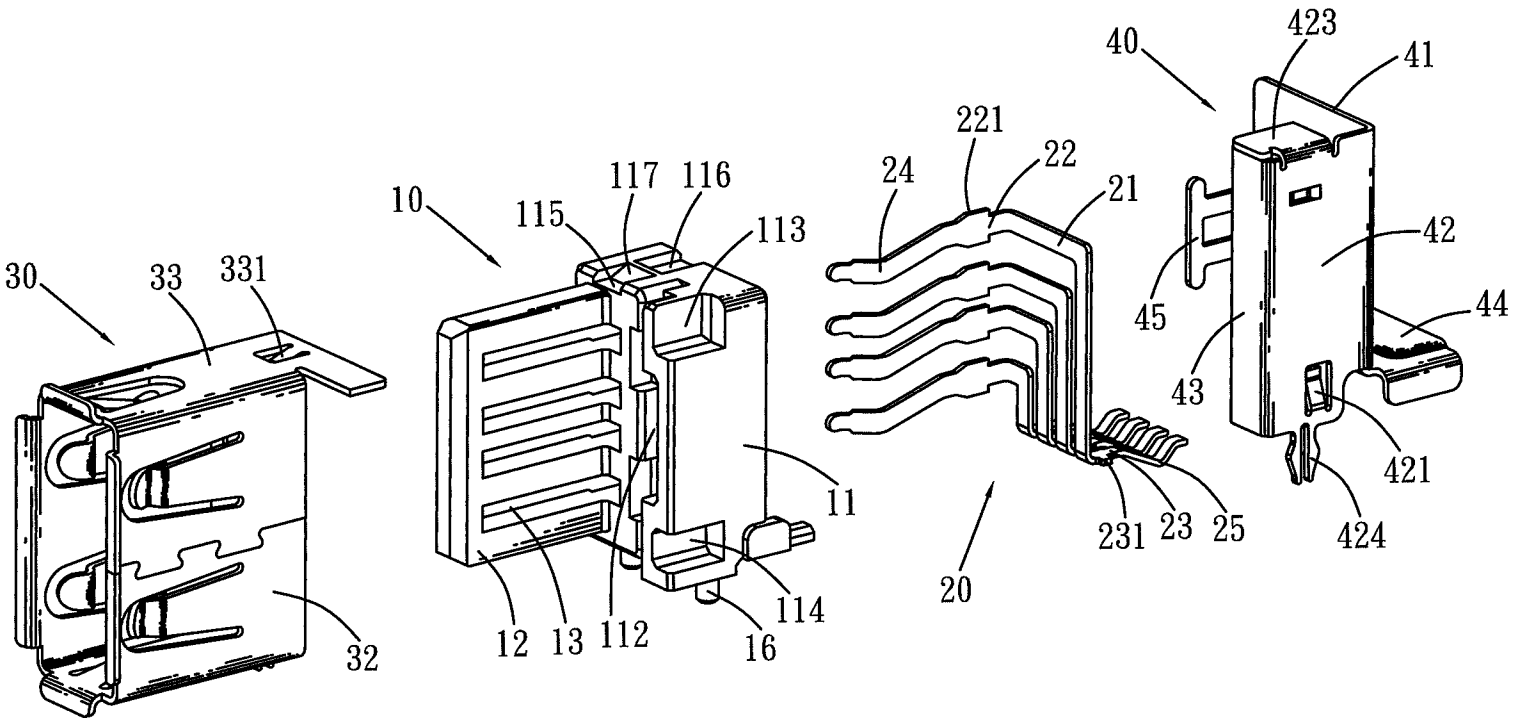
FIG. 3 is an exploded perspective view of the electrical connector of FIG. 1.
Figure 6:
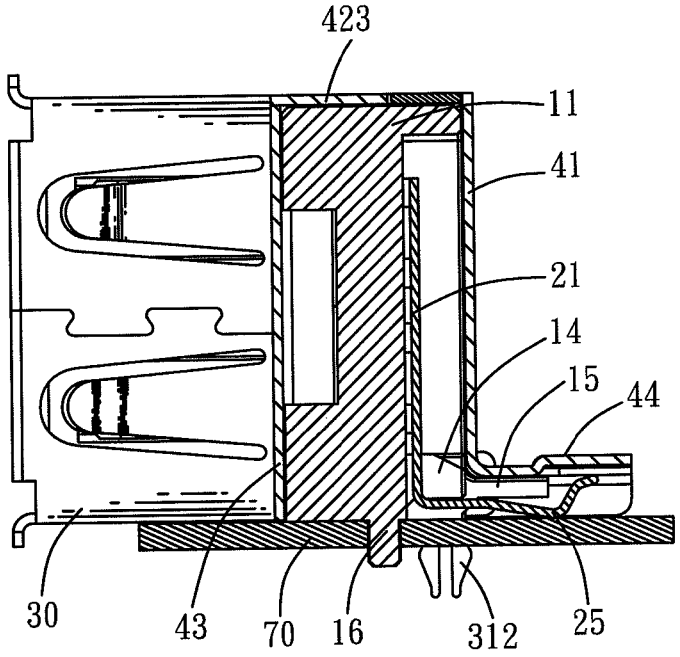
FIG. 6 is a cross-sectional view showing that the electrical connector of FIG. 1 is mounted to a circuit board.

With reference to FIG. 1, FIG. 3 and FIG. 6, an electrical connector in accordance with an embodiment of the present invention is adapted for being vertically mounted on a circuit board 70 placed horizontally. The electrical connector includes an insulating housing 10, a plurality of conductive terminals 20, a front shell 30 looped from a metal plate to show a rectangular tubular shape, and a rear shell 40 curved from a metal plate.

Referring to FIG. 1, FIG. 3 and FIG. 6, the insulating housing 10 has an erect base body 11 and an erect tongue board 12 extending forward from a front of the base body 11. Each of the conductive terminals 20 has a fastening arm 21 vertically disposed in the base body 11 of the insulating housing 10. A top distal end of the fastening arm 21 extends forward and is inclined sideward to form a contact arm 24 of which a free end is slantwise bent back. A bottom distal end of the fastening arm 21 extends rearward and is inclined downward to form a touching arm 25 of which a free end is slantwise bent back. The contact arms 24 elastically project sideward out of a side face of the tongue board 12 and are arranged at regular intervals along a vertical direction. The touching arms 25 project rearward out from a bottom of the base body 11 and are horizontally arranged at regular intervals along a transverse direction. The front shell 30 is mounted rearward to the insulating housing 10 with the tongue board 12 together with the contact arms 24 of the conductive terminals 20 being apart located therein. The rear shell 40 is covered to the base body 11 of the insulating housing 10 and over the touching arms 25 of the conductive terminals 20. The electrical connector is mounted onto the circuit board 70 with the touching arms 25 of the conductive terminals 20 being elastically against and further pressed upward by the circuit board 70 to form electrical connection with the circuit board 70.

Referring to FIG. 3, FIG. 4, FIG. 5 and FIG. 6, a back of the base body 11 is concaved forward to form a receiving chamber 17. The fastening arm 21 of the conductive terminal 20 is substantially of an inverted-L shape. The fastening arms 21 are apart arranged in the receiving chamber 17 of the base body 11 at regular intervals with the overall length thereof lengthening by degrees from the bottom up. The rear shell 40 seals up the receiving chamber 17. The side face of the tongue board 12 of the insulating housing 10 defines a plurality of terminal grooves 13 arranged at regular intervals along the vertical direction and each longitudinally extending through the base body 11 to communicate with the receiving chamber 17. A connecting arm 22 is longitudinally connected between the top distal end of the fastening arm 21 and the contact arm 24 with a pair of fixing barbs 221 oppositely protruding at two edges thereof. The contact arm 24 passes forward through the base body 11. The fixing barbs 221 are snapped in two opposite inner sidewalls of a rear of the corresponding terminal groove 13 to secure the connecting arm 22 in the rear of the terminal groove 13 so as to ensure the contact arm 24 is steadily pressed into the terminal groove 13. A plurality of restraining portions 14 is protruded in a bottom of the receiving chamber 17 of the base body 11 and arranged at regular intervals along the transverse direction. A holding arm 23 is longitudinally connected between the bottom distal end of the fastening arm 21 and the touching arm 25 with a fixing ear 231 protruding sideward at one edge thereof. A bottom of each fastening arm 21 is clamped between adjacent two restraining portions 14. The fixing ear 231 abuts against a bottom of the corresponding restraining portion 14 to prevent the conductive terminal 20 from moving upward when the circuit board 70 presses the touching arm 25 upward.

Referring to FIG. 1, FIG. 3, FIG. 4 and FIG. 6, the rear shell 40 has a rear plate 41, a lateral plate 42 extending forward from one side edge of the rear plate 41, and a front plate 43 bent sideward from a front edge of the lateral plate 42 and facing the rear plate 41. A bottom edge of the rear plate 41 extends rearward to form a cover plate 44 with two opposite sides thereof bent downward. A pair of supporting arms 15 protrudes rearward from two sides of a bottom of the back of the base body 11 of the insulating housing 10. The touching arms 25 of the conductive terminals 20 are located between the supporting arms 15. The rear shell 40 is mounted downward to the base body 11 until the cover plate 44 is across the supporting arms 15 to be apart covered over the touching arms 25 of the conductive terminals 20. The rear plate 41 is against the back of the base body 11 and the front plate 43 is against one side of the front of the base body 11 and away from the tongue board 12. A middle of the cover plate 44 covering the touching arms 25 of the conductive terminals 20 is further concaved upward to avoid the touching arms 25 contacting the cover plate 44 when the touching arms 25 are elastically pressed upward by the circuit board 70.

Referring to FIG. 2, FIG. 3, FIG. 4, FIG. 5 and FIG. 6, a substantial middle of the other side edge of the rear plate 41 of the rear shell 40 is connected with a T-shaped locking plate 45 with a locking hole 451 opened therein. The front shell 30 has a first side plate 31 of which a substantial middle of a rear is die-cut to form a T-shaped locking gap 311. The rear of the first side plate 31 is against one outer side of the base body 11. A locking block 111 is protruded at the outer side of the base body 11 and located in the locking gap 311. The rear shell 40 is mounted downward to the base body 11. Then the locking plate 45 is bent forward by an external jig to be buckled in the locking gap 311 and the locking block 111 is buckled in the locking hole 451.

Figure 4:
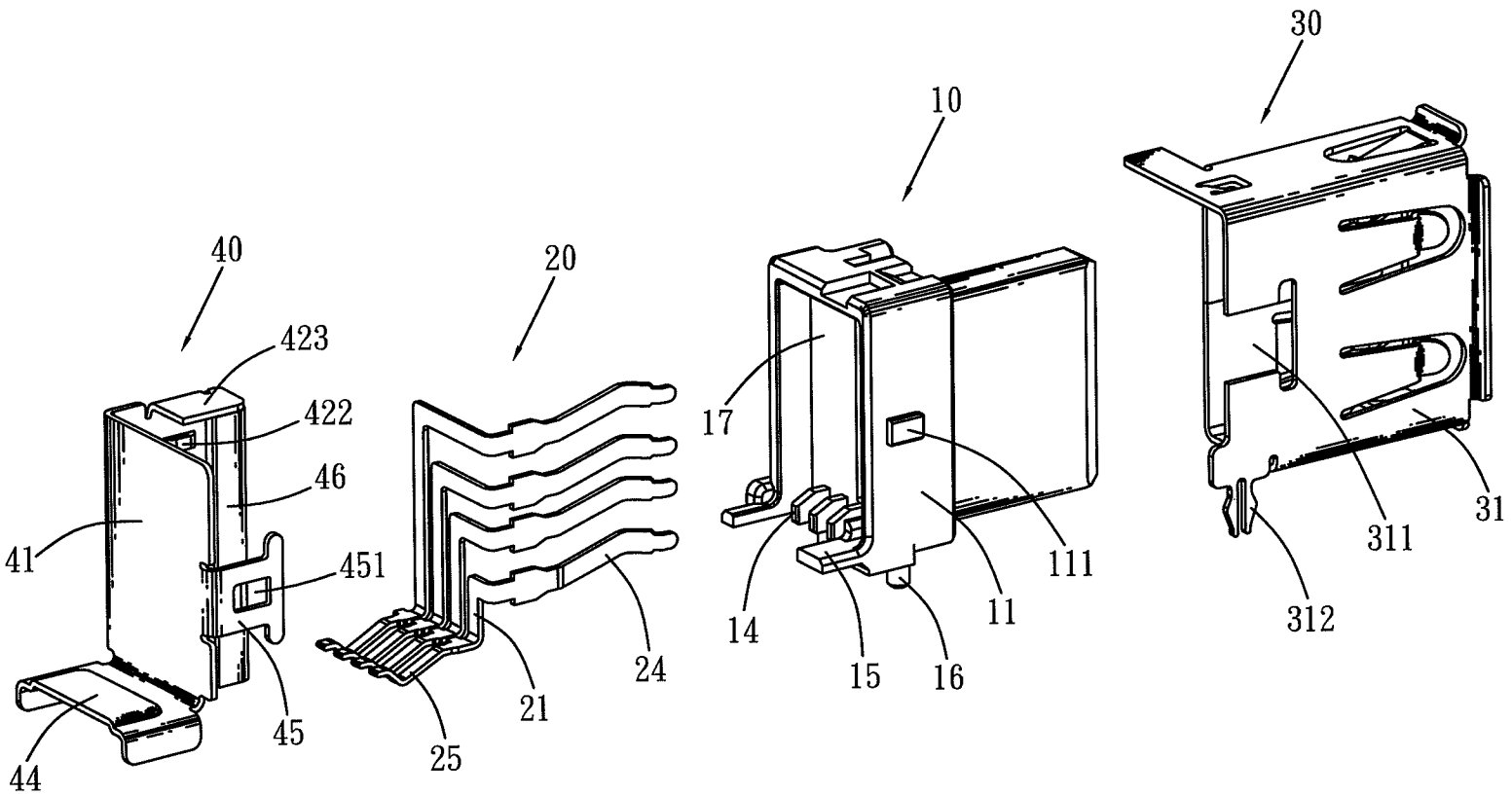
FIG. 4 is another exploded perspective view of the electrical connector of FIG. 2.

Referring to FIG. 1, FIG. 3 and FIG. 4, a vertical edge of the front plate 43 of the rear shell 40 is bent rearward to form an inserting plate 46. One side of the front of the base body 11 is concaved rearward to form an inserting slot 112 extending vertically through the base body 11. The front shell 30 has a second side plate 32 of which a rear is inserted rearward in the inserting slot 112. The rear shell 40 is mounted downward to the base body 11 with the inserting plate 46 being inserted downward in the inserting slot 112 and abutting against the rear of the second side plate 32 of the front shell 30.

Referring to FIG. 1 and FIG. 3, a top edge of the lateral plate 42 of the rear shell 40 extends inward to form a cover slice 423. The lateral plate 42 is further punched inward to form a stopping portion 422 at an upper position thereof and an elastic slice 421 at a lower position thereof. A corresponding outer side of the base body 11 defines a receiving fillister 113 penetrating through a top thereof and a buckling fillister 114 at a lower position thereof. While the rear shell 40 is mounted downward to the base body 11, the elastic slice 421 elastically resists against the corresponding outer side of the base body 11 until it is set free to be buckled in the buckling fillister 114, the stopping portion 422 is blocked in the receiving fillister 113 and the cover slice 423 covers the receiving fillister 113.

Figure 5:
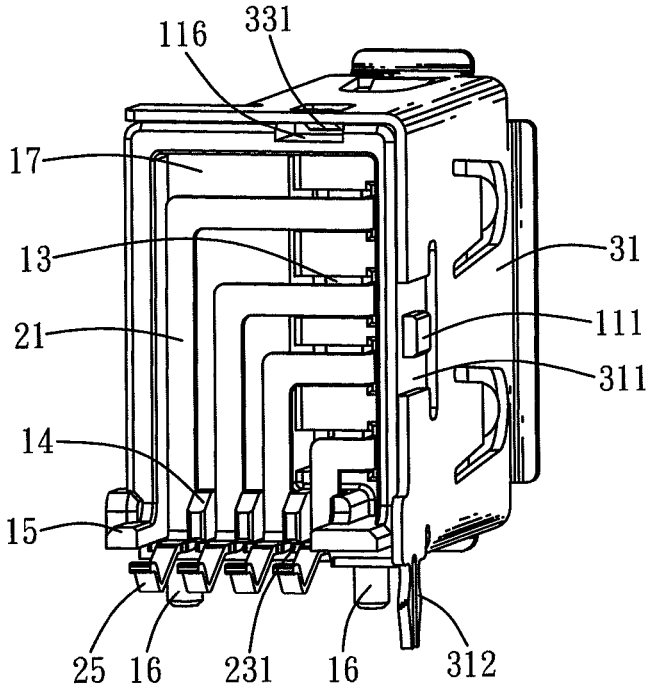
FIG. 5 is another perspective view of the electrical connector of FIG. 2 excluding a rear shell.

Referring to FIG. 1, FIG. 3 and FIG. 5, the front shell 30 has a top plate 33 of which a rear is die-cut downward to form an elastic arm 331. A locking fillister 116 and a guiding fillister 115 are opened in a top face of the base body 11 of the insulating housing 10. The guiding fillister 115 is located in front of the locking fillister 116 and penetrates through the front of the base body 11. A rear inner sidewall of the guiding fillister 115 is designed as a slope 117 for guiding the elastic arm 331 through the guiding fillister 115 to be locked in the locking fillister 116 while the front shell 30 is assembled rearward to the insulating housing 10.

The bottom of the base body 11 protrudes downward to form a pair of fastening pillars 16 inserted in the circuit board 70. A bottom edge of the front shell 30 protrudes downward to form a first gripping foot 312 and a bottom edge of the rear shell 40 protrudes downward to form a second gripping foot 424. The gripping feet 312, 424 are inserted in the circuit board 70 by a locking method to removably secure the electrical connector on the circuit board 70. In this embodiment, the first gripping foot 312 protrudes downward from a bottom edge of the rear of the first side plate 31 of the front shell 30, and the second gripping foot 424 protrudes downward from a bottom edge of the lateral plate 42 of the rear shell 40.

As described above, the electrical connector and the circuit board 70 are electrically connected with each other by way of the touching arms 25 of the conductive terminals 20 elastically abutting against the circuit board 70, and the gripping feet 312, 424 are inserted in the circuit board 70 by a locking method, so that ensure a steady electrical connection between the electrical connector and the circuit board 70 even if the touching arms 25 are not coplanar due to the inaccurate manufacturing. It is rather short-time and convenient for mounting the electrical connector to the circuit board 70. Moreover, the touching arms 25 of the conductive terminals 20 and the shells 30, 40 are easily removed from the circuit board 70 for the convenience of replacing the electrical connector when it doesn't work.

What is claimed is:

1. An electrical connector adapted for being vertically mounted on a circuit board placed horizontally, comprising:

an insulating housing having an erect base body and an erect tongue board extending forward from a front of the base body;

a plurality of conductive terminals each having a fastening arm vertically disposed in the base body of the insulating housing, a top distal end of the fastening arm extending forward and being inclined sideward to form a contact arm of which a free end is slantwise bent back, and a bottom distal end of the fastening arm extending rearward and being inclined downward to form a touching arm of which a free end is slantwise bent back, the contact arms elastically projecting sideward out of a side face of the tongue board and being arranged at regular intervals along a vertical direction, the touching arms projecting rearward out from a bottom of the base body and being horizontally arranged at regular intervals along a transverse direction;

a front shell looped from a metal plate to show a rectangular tubular shape, the front shell being mounted rearward to the insulating housing with the tongue board together with the contact arms of the conductive terminals being apart located therein; and a rear shell curved from a metal plate, the rear shell being covered to the base body of the insulating housing and over the touching arms of the conductive terminals, wherein the electrical connector is mounted onto the circuit board with the touching arms of the conductive terminals being elastically against and further pressed upward by the circuit board to form electrical connection with the circuit board, wherein a back of the base body is concaved forward to form a receiving chamber, the fastening arm of the conductive terminal is substantially of an inverted-L shape, the fastening arms apart arranged in the receiving chamber of the base body at regular intervals with the overall length thereof lengthening by degrees from the bottom up, the rear shell seals up the receiving chamber, and wherein a plurality of restraining portions is protruded in a bottom of the receiving chamber of the base body and arranged at regular intervals along, the transverse direction, a holding arm is longitudinally connected between the bottom distal end of the fastening arm and the touching arm with a fixing ear protruding sideward at one edge thereof, a bottom of each fastening arm is clamped between adjacent two restraining portions, the fixing ear abuts against a bottom of the corresponding restraining portion to prevent the conductive terminal from moving upward when the circuit board presses the touching arm upward.

2. The electrical connector as claimed in claim 1, wherein the side face of the tongue board of the insulating housing defines a plurality of terminal grooves arranged at regular intervals along the vertical direction and each longitudinally extending through the base body to communicate with the receiving chamber, a connecting arm is longitudinally connected between the top distal end of the fastening arm and the contact arm with a pair of fixing barbs oppositely protruding at two edges thereof, the contact arm passes forward through the base body, the fixing barbs are snapped in two opposite inner sidewalls of a rear of the corresponding terminal groove to secure the connecting arm in the rear of the terminal groove so as to ensure the contact arm is steadily pressed into the terminal groove.

3. The electrical connector as claimed in claim 1, wherein the bottom of the base body protrudes downward to form a pair of fastening pillars inserted in the circuit board, a bottom edge of the front shell protrudes downward to form a first gripping foot and a bottom edge of the rear shell protrudes downward to form a second gripping foot, the gripping feet are inserted in the circuit board by a locking method.

4. An electrical connector adapted for being vertically mounted on a circuit board placed horizontally, comprising:

in insulating housing having an erect base body and an erect tongue board extending forward from a front of the base body;

a plurality of conductive terminals each having a fastening arm vertically disposed in the base body of the insulating housing, a top distal end of the fastening arm extending forward and being inclined sideward to form a contact arm of which a free end is slantwise bent back, and a bottom distal end of the fastening arm extending rearward and being inclined downward to form a touching arm of which a free end is slantwise bent back, the contact arms elastically projecting sideward out of a side face of the tongue board and being arranged at regular intervals along a vertical direction, the touching arms projecting rearward out from a bottom of the base body and being horizontally arranged at regular intervals along a transverse direction;

a front shell looped from a metal plate to show a rectangular tubular shape, the front shell being mounted rearward to the insulating housing with the tongue board together with the contact arms of the conductive terminals being apart located therein; and a rear shell curved from a metal plate, the rear shell being, covered to the base body of the insulating housing and over the touching arms of the conductive terminals, wherein the electrical connector is mounted onto the circuit board with the touching arms of the conductive terminals being elastically against and further pressed upward by the circuit board to form electrical connection with the circuit board, wherein the rear shell has a rear plate, a lateral plate extending forward from one side edge of the rear plate, and a front plate bent sideward from a front edge of the lateral plate and facing the rear plate, a bottom edge of the rear plate extends rearward to form a cover plate with two opposite sides thereof bent downward, a pair of supporting arms protrude rearward from two sides of a bottom of a back of the base body of the insulating housing, the touching arms of the conductive terminals are located between the supporting anus, the rear shell is mounted downward to the base body until the cover plate is across the supporting arms to be apart covered over the touching arms of the conductive terminals, the rear plate is against the back of the base body and the front plate is against one side of the front of the base body and away from the tongue board.

5. The electrical connector as claimed in claim 4, wherein a middle of the cover plate covering the touching arms of the conductive terminals is further concaved upward for avoiding the touching arms contacting the cover plate when the touching arms are elastically pressed upward by the circuit board.

6. The electrical connector as claimed in claim 4, wherein a substantial middle of the other side edge of the rear plate of the rear shell is connected with a T-shaped locking plate with a locking hole opened therein, the front shell has a first side plate of which a substantial middle of a rear is die-cut to form a T-shaped locking gap, the rear of the first side plate is against one outer side of the base body, a locking block is protruded at the outer side of the base body and located in the locking gap, the rear shell is mounted downward to the base body, then the locking plate is bent forward by an external jig to be buckled in the locking gap and the locking block is buckled in the locking hole.

7. The electrical connector as claimed in claim 4, wherein a vertical edge of the front plate of the rear shell is bent rearward to form an inserting plate, one side of the front of the base body is concaved rearward to form an inserting slot extending vertically through the base body, the front shell has a second side plate of which a rear is inserted rearward in the inserting slot, the rear shell is mounted downward to the base body with the inserting plate being inserted downward in the inserting slot and abutting against the rear of the second side plate of the front shell.

8. The electrical connector as claimed in claim 4, wherein a top edge of the lateral plate of the rear shell extends inward to form a cover slice, the lateral plate is further punched inward to form a stopping portion at an upper position thereof and an elastic slice at a lower position thereof, a corresponding outer side of the base body defines a receiving fillister penetrating through a top thereof and a buckling fillister at a lower position thereof, while the rear shell is mounted downward to the base body, the elastic slice elastically resists against the corresponding outer side of the base body until it is set free to be buckled in the buckling fillister, the stopping portion is blocked in the receiving fillister and the cover slice covers the receiving fillister.

9. An electrical connector adapted for being vertically mounted on a circuit laced horizontally, comprising:

an insulating housing having an erect base body and an erect tongue board extending forward from a front of the base body;

a plurality of conductive terminals each having a fastening arm vertically disposed in the base body of the insulating housing, a top distal end of the fastening arm extending forward and being inclined sideward to form a contact arm of which a free end is slantwise bent back, and a bottom distal end of the fastening arm extending rearward and being inclined downward to form a touching arm of which a free end is slantwise bent back, the contact arms elastically projecting sideward out of a side face of the tongue board and being arranged at regular intervals along a vertical, direction, the touching arms projecting rearward out from a bottom of the base body and being horizon tali arranged at regular intervals along a transverse direction;

a front shell looped from a metal plate to show a rectangular tubular shape, the front shell being mounted rearward to the insulating housing with the tongue board together with the contact arms of the conductive terminals being apart located therein; and a rear shell curved from a metal plate, the rear shell being covered to the base body of the insulating housing and over the touching arms of the conductive terminals, wherein the electrical connector is mounted onto the circuit board with the touching arms of the conductive terminals being elastically against and further pressed upward by the circuit board to form electrical connection with the circuit board, wherein the front shell has a top plate of which a rear is die-cut downward to form an elastic arm, a locking fillister and a guiding fillister are opened in a top face of the base body of the insulating housing, the guiding fillister is located in front of the locking fillister and penetrates through the front of the base body, a rear inner sidewall of the guiding fillister is designed as a slope for guiding the elastic arm through the guiding fillister to be locked in the locking fillister while the front shell is assembled rearward to the insulating housing.

* * * * *